US007927125B1

(12) United States Patent
Zieman et al.

(10) Patent No.: US 7,927,125 B1
(45) Date of Patent: Apr. 19, 2011

(54) CABLE FIXTURE DEVICE WITH A SLIDER BAR

(75) Inventors: Christopher Eugene Zieman, Chapel Hill, NC (US); Robert Joseph Baumler, Waseca, MN (US)

(73) Assignees: Emerson Network Power Connectivity Solutions, Inc., Bannockburn, IL (US); Cisco Technology, Inc., San Jose, CA (US)

( * ) Notice: Subject to any disclaimer, the term of this patent is extended or adjusted under 35 U.S.C. 154(b) by 0 days.

(21) Appl. No.: 12/109,146

(22) Filed: Apr. 24, 2008

Related U.S. Application Data

(60) Provisional application No. 60/974,309, filed on Sep. 21, 2007.

(51) Int. Cl.
*H01R 13/627* (2006.01)

(52) U.S. Cl. ..... 439/355; 439/347; 439/752

(58) Field of Classification Search ..... 439/721, 439/640, 173, 49, 923, 540.1, 310, 364, 355, 439/752, 347
See application file for complete search history.

(56) References Cited

U.S. PATENT DOCUMENTS 3,501,736 A * 3/1970 Norris ..... 439/353
5,122,080 A * 6/1992 Hatagishi et al. ..... 439/595
5,326,287 A * 7/1994 Hamakita et al. ..... 439/752
5,486,122 A * 1/1996 Oda et al. ..... 439/752
5,830,013 A * 11/1998 Saito et al. ..... 439/595
6,655,998 B1 * 12/2003 Kurimoto ..... 439/752

OTHER PUBLICATIONS

Sisco System, Inc. Cisco Quick Start Guide Cabling the Cisco uBR10-MC5X20S/U/H Cable Interface Line Card with Universal Cable Holder-UCH2, http://www.cisco.com/en/US/docs/interfaces_modules/cable/broadband_processing_engines/ubr10_mc5x20s_u_h/quick/start/MC52_cb2.html, © 1992-2009 Cisco Systems, Inc. All rights reserved.*

Cisco Systems, Inc. Cisco uBR10-MC5X20S/U/H Cable Interface Line Card Hardware Installation Guide. http://www.cisco.com/en/US/docs/interfaces_modules/cable/broadband_processing_engines/ubr10_mc5x20s_u_h/installation/guide/ubrmc520.pdf. Last accessed Nov. 26, 2008.

* cited by examiner

*Primary Examiner* — Hae Moon Hyeon
(74) *Attorney, Agent, or Firm* — Karl D. Kovach

(57) ABSTRACT

A robust multi-port front panel RF (radio frequency) connector system design using a single lead screw is provided. The system allows for individual connector removal from the header while installed. Additionally, the system employs a user applied torque limiting feature for robustness. This individual connector removal can be provided by way of a slider bar which retains cables in place when in the 'closed' or 'locked' position.

17 Claims, 15 Drawing Sheets

CABLE FIXTURE DEVICE WITH A SLIDER BAR

CROSS-REFERENCE TO RELATED APPLICATIONS

This application claims the benefit of U.S. Provisional Patent application Ser. No. 60/974,309 entitled "COAXIAL FIXTURE DEVICE" and filed Sep. 21, 2007. The entirety of the above-noted application is incorporated by reference herein.

BACKGROUND

A cable modem termination system (CMTS) refers to hardware that is typically located in a cable company's master facility for receiving television signals for processing and distribution over a cable television system. This location is commonly referred to as a 'headend.' Most often, the CMTS is deployed at a cable company hubsite and is used to provide high speed data services, such as cable Internet and Voice-over-Internet Protocol (VoIP) to cable service subscribers.

To provide high speed data services (e.g., Internet, VoIP), the cable service provider connects its headend to the Internet via very high capacity data links, for example, through a network service provider. On the service subscriber side of the headend, the CMTS enables communication with subscribers' cable-equipped modems. While a CMTS is often capable of serving cable modem population sizes ranging from 4,000 cable modems to 150,000 or more, a particular headend can include multiple CMTSs so as to effectively service the cable modem population served by that headend.

A CMTS can be described as a switch or router having Ethernet-type connections on one side and coax radio frequency (RF) interfaces on the other. The Ethernet-type connections are used to bridge or route Internet traffic while the coax RF interfaces are employed to carry RF signals to and from the subscriber's cable modem. CMTSs typically only carry IP (Internet Protocol) traffic which is traffic specifically destined for the cable modem from the Internet, known as downstream traffic. Upstream data, or data from cable modems to the headend or Internet, is typically carried in Ethernet frames.

CMTS boxes are getting smaller while the physical plant ports are growing. Conventionally, the standard coaxial cable interface in the industry is the F-connector with RG-59 or RG-6 cable connectivity. Unfortunately, these conventional architectures are not maintainable in high density designs due to cable diameter, required access for F-connector installation, and cable bend radius.

Somewhat recent developments have been directed to cabling techniques that allow for higher densities in small form factors. For instance, one development was a system to fixture 1-10RF coaxial MCX type connectors and to provide driving and aligning features to connect to a mating LC (linecard) side connector.

One limitation of these conventional systems is that an external extraction tool had to be used to remove connectors from the header. This tool was required as the connector was retained within the header using a spring (or retaining ring) that contracts and expands over a lip. Additionally, in order to insert the extraction tool, the header must break all 10 RF connections and be removed from the LC in order to access the front of the header. In other words, the removal tool had to be inserted from the front end of the header thereby requiring that all connections must be broken. This requirement to break all connections limits the troubleshooting and reconfiguration capabilities when the cable plant is live.

DESCRIPTION

Overview

Figure 1:
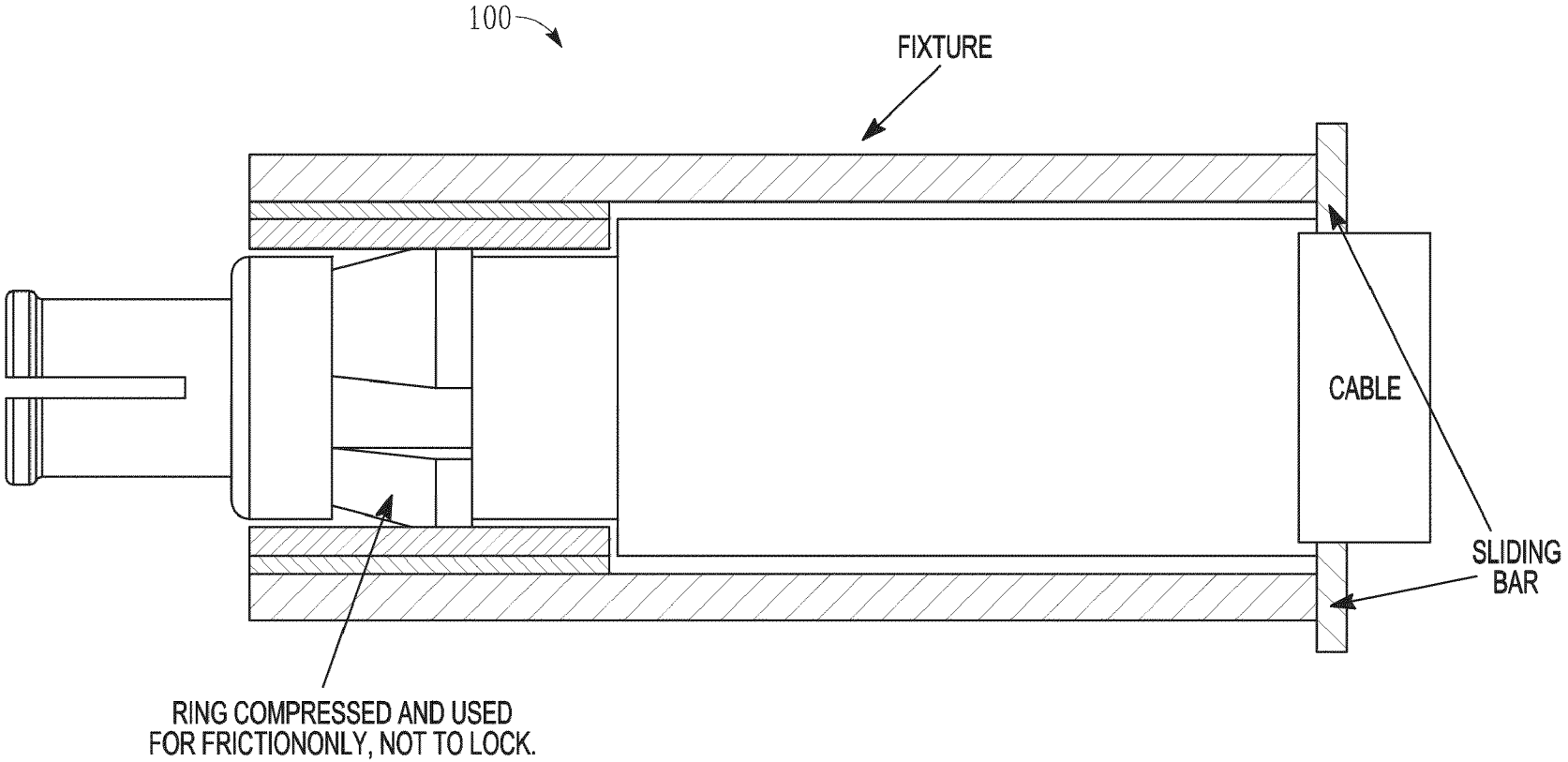
FIG. 1 illustrates an example coaxial fixture device (universal cable holder (UCH)) that enables individual connector removal in accordance with an embodiment.

The following presents a simplified overview of the specification in order to provide a basic understanding of some aspects of the specification. This overview is not an extensive overview of the specification. It is not intended to identify key/critical elements of the specification or to delineate the scope of the specification. Its sole purpose is to present some concepts of the specification in a simplified form as a prelude to the more detailed description that is presented later.

The specification disclosed and claimed herein, in one aspect thereof, comprises a cable modem termination system (CMTS) that provides a high density apparatus that has the robustness of the F-connector, is miniature, capable of quick disconnect, and/or provides an interface that allows per port troubleshooting and installation. Essentially, the universal cable holder (UCH) described in this specification can be employed in most any application where coaxial (among others) cabling is employed. In other words, in a coaxial application, the UCH can provide a high density implementation that has the robustness of the conventional F connector, is miniature, enables quick disconnection, and provides an interface that allows per port troubleshooting and removal/installation in most any coaxial cabling system.

In aspects of the subject specification, a RF (radio frequency) multi-port facility interface connector system is provided. This system can employ the use of a MCX-style interface on the CMTS PCB (power connection box) and a special mini-coax plant side connector in a connector alignment and fixturing device (e.g., UCH). The UCH can hold, align, and by way of a lead screw, safely and securely drive the facility connectors into the CMTS PCB connector for RF connectivity. The UCH can also employ a slider bar that allows for individual cable removal from the UCH while it is installed (and live) on the faceplate of a linecard.

The UCH can also be equipped with a torque limiting feature to alleviate damage and/or breakage of the lead screw thus increasing robustness. It will be understood that the subject apparatus can connect multiple RF connections via a single lead screw. Still further, the subject UCH is robust enough for repeated facility interconnectivity, can use miniature connectors for the system, and can provide connector reconfiguration in the installed (e.g., live) state.

To the accomplishment of the foregoing and related ends, certain illustrative aspects of the specification are described herein in connection with the following description and the annexed drawings. These aspects are indicative, however, of but a few of the various ways in which the principles of the specification can be employed and the subject specification is intended to include all such aspects and their equivalents. Other advantages and novel features of the specification will become apparent from the following detailed description of the specification when considered in conjunction with the drawings.

BRIEF DESCRIPTION OF EXAMPLE EMBODIMENTS

The specification is now described with reference to the drawings, wherein like reference numerals are used to refer to like elements throughout. In the following description, for purposes of explanation, numerous specific details are set forth in order to provide a thorough understanding of the subject specification. It may be evident, however, that the specification can be practiced without these specific details. In other instances, well-known structures and devices are shown in block diagram form in order to facilitate describing the specification.

Referring initially to the drawings, FIG. 1 illustrates a cross-section of a coaxial fixture device 100 that enables individual connector removal while installed on the LC (linecard). As shown, the captivation device illustrated in FIG. 1 does not use the front expansion ring of the connector to retain the cable as is used in conventional systems. Rather, the device illustrated employs a step or ledge on the rear of the connector between the crimp joint and cable as a feature to restrain the connector in the header (fixture).

As shown, in this aspect, the ring on the coaxial connector is employed for friction only and not to lock or permanently retain the connector into the fixture. Rather, a sliding bar is employed to retain the connector into the fixture. The functionality of this slider bar mechanism will be better described with reference to the figures that follow. Essentially, the slider bar mechanism modifies the opening in the fixture from an 'open' to 'close' position. This modification is effected by the shape of the cutouts in the slider bar. When in the open position, the aperture(s) is unobstructed thereby allowing the connector to enter the fixture. Upon traversing the mechanism into a closed position, the aperture(s) becomes obstructed and prevents the connector from pulling out of the fixture. More detailed drawings of example configurations are illustrated in the figures that follow.

While the examples described herein are directed to coaxial embodiments, it is to be understood that the features, functions, and benefits or the innovation can be applied to most any alternative cable and connector arrangements (e.g., RJ-45). Additionally, it is to be understood that, although a specific number of cables is illustrated in the example embodiments, most any number of cables can be employed in alternative aspects. These alternatives are to be included within the scope of this disclosure and claims appended hereto.

Conventional connector systems are fixed cable configurations that do not allow for tool-less cable removal once installed. Additionally, the conventional systems require all cables to be disengaged together and therefore do not allow for individual cable removal (e.g., for troubleshooting). To the contrary, the subject system provides for individual cable removal when installed and does not require any special removal tools to extract cables from the header. Additionally, conventional systems employ more than one lead screw to secure the header. It will be appreciated that this can often cause binding of the connectors or header block and requires the user to alternate between tightening one then the other to ensure alignment of the connectors to the header or faceplate.

As will be described infra, using a single lead screw takes another factor out of the installation that can cause damage to the interface and ensures only a single consistent way to install the header. Without a torque limiting feature, other systems that use a screw to hold the header in place run the risk of shearing the screws due to excess torque (e.g., user applied torque). In accordance therewith, the subject connector can employ a user torque limiting feature that alleviates risk of shearing the lead screw. These and other features, functions and benefits will be described in more with reference to the figures that follow.

Figure 2:
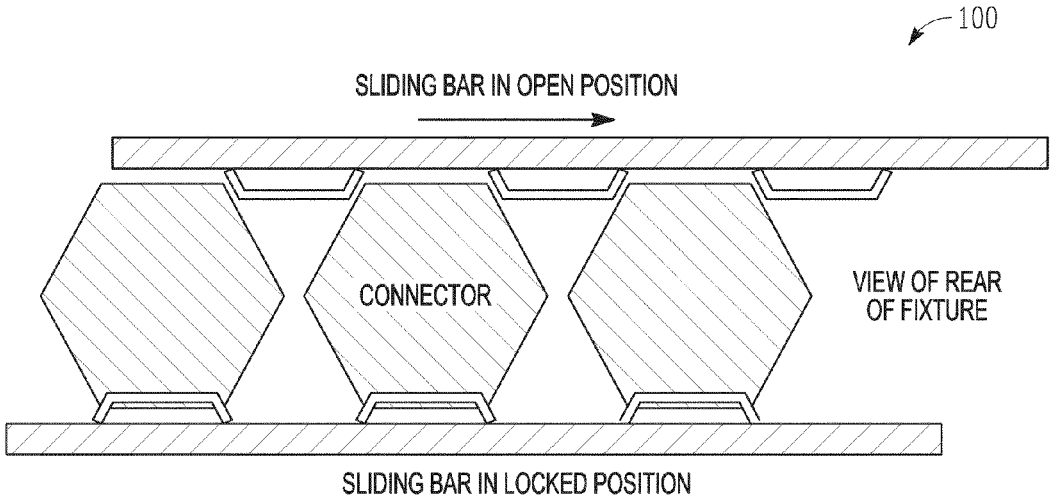
FIG. 2 illustrates a cross-sectional view of a multi-coaxial system in accordance with an aspect of the specification.

FIG. 2 illustrates a cross-sectional view of the subject specification in accordance with an aspect of the specification. More particularly, as shown in FIG. 2, the front expansion ring of the cable is not used to secure the cable. Rather, as discussed with reference to FIG. 1, the front expansion ring merely supplies nominal force to hold the cable in place when the slide bar is in the 'open' or 'unlocked' position. As illustrated, the step on the rear of the connector between the crimp joint and cable can be used as a feature to restrain the connector in the header (fixture) when the slider bar is in the 'closed' or 'locked' position. The rear feature is selectively stepped on the header such that when the slider bar mechanism is moved to one side or the other, it allows the cables to be removed.

Figure 3:
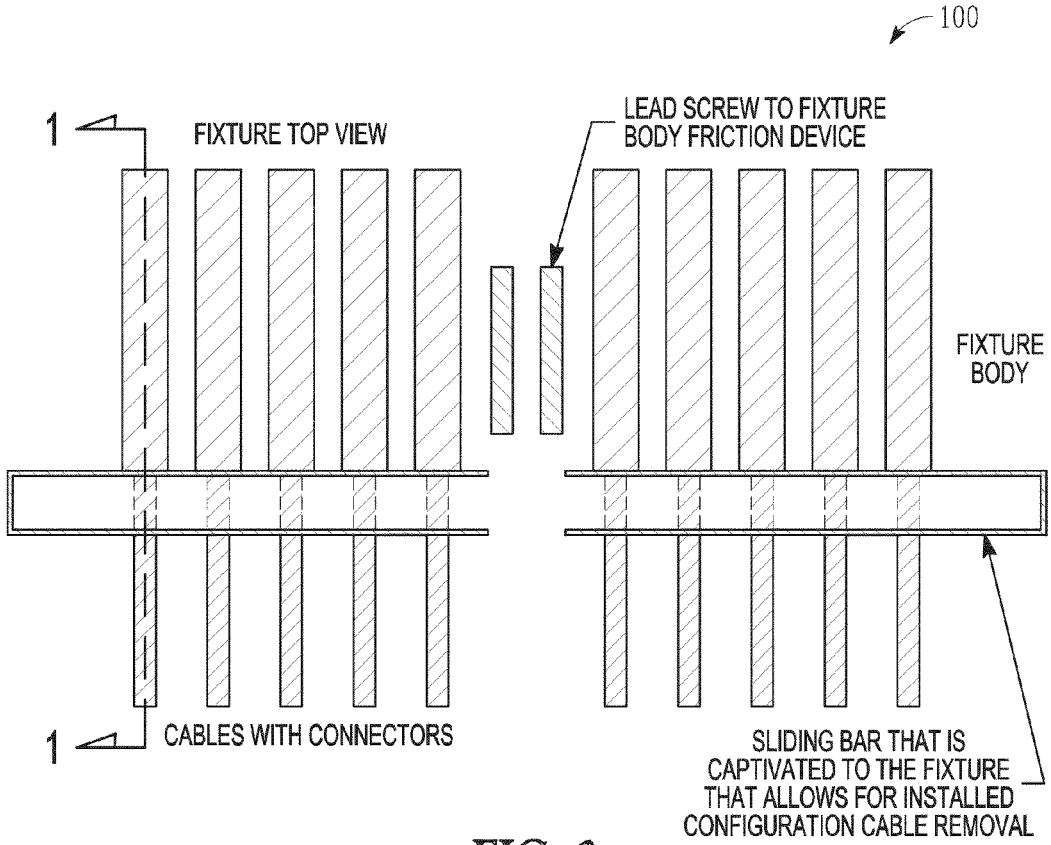
FIG. 3 illustrates a top view of a fixture in accordance with an aspect of the specification.

FIG. 3 illustrates a top view of the fixture in accordance with an aspect. As shown in this view, the connector fixture housing can support multiple coaxial connections as desired (e.g., 10). The mechanism of restraining and releasing (e.g., sliding bar) the connectors is scalable from one or many ports in a header (fixture). As can be understood, this configuration enables any one (or more) of the connectors to be removed without having to disconnect the remaining connectors. In other words, cables can be removed while live without disconnecting or interrupting service of any of the other coaxial cables.

As illustrated in FIG. 3, it is further to be understood that a single fixture can employ more than a single slider bar mechanism. For example, as illustrated, in FIG. 3 as well as many of the figures that follow, a separate slider bar can be employed for each group of connectors. Here, two slider bar mechanisms are employed, each to secure five connectors. It is to be understood that most any configuration can be employed without departing from the spirit and/or scope of this specification and claims appended hereto.

While one aspect of the system is employed to connect coaxial cables to a cable modem termination service (CMTS), it is to be understood that other applications exist that can employ the subject specification. For example, the features, functions and benefits of the specification can be employed to most any cabling application without departing from the spirit and/or scope of this specification and claims appended hereto.

Figure 4:
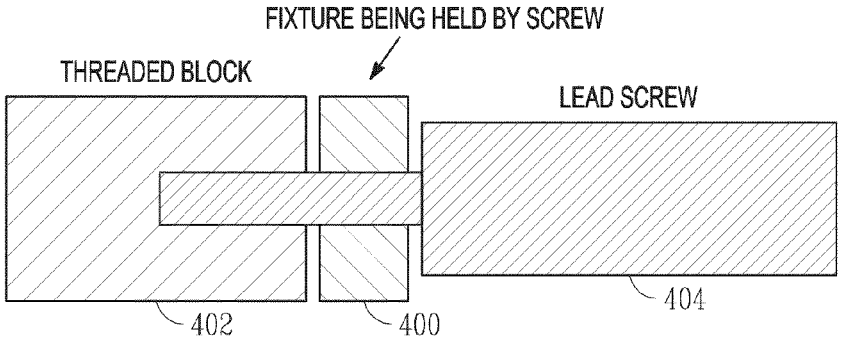
FIG. 4 illustrates a system that employs a torque limiter in accordance with an aspect.

FIG. 4 is a block schematic that illustrates connection of a fixture 400 (e.g., universal cable holder (UCH)) to a header block 402. More specifically, in one aspect, a lead screw 404 can be used to attach the fixture 400 to the header block 402. It is to be understood that the lead screw can draw the cable connectors into the header block. Actuation is performed by the lead screw which removes user variability as in multiple lead screw systems. Note that the components of FIG. 4 are not necessarily drawn to scale. Rather, the cross-sectional view is provided to add perspective to the application of the UCH and lead screw functionality.

Figure 5:
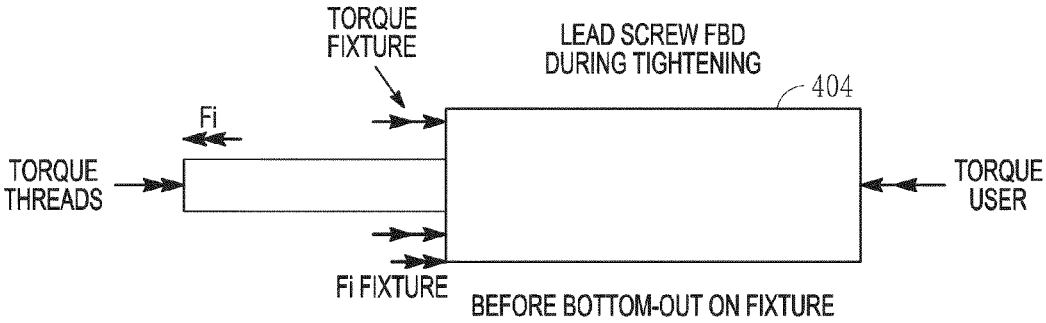
FIG. 5 illustrates multiple forces present upon a UCH in accordance with an aspect prior to bottom-out on fixture.
Figure 6:
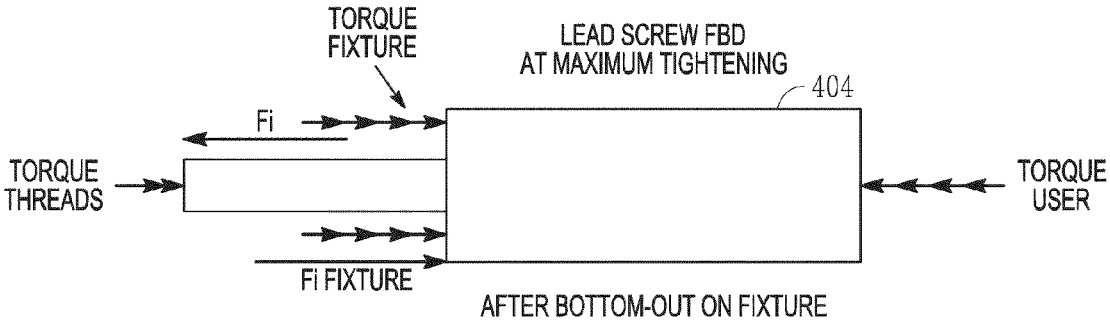
FIG. 6 illustrates multiple forces present upon a UCH in accordance with an aspect after bottom-out on fixture.

Still further, the UCH described herein can be equipped with a torque limiter which protects the secure screw from damage and/or failure. Typically, when a user tightens a screw to a front panel they tighten to make sure it is very secure. On smaller screws (as used in connection with the subject apparatus), there is often a tendency to over-tighten. Similarly, on large screws, there is a tendency to under-tighten. FIGS. 5 and 6 illustrate the forces associated with tightening a lead screw. Essentially, FIGS. 5 and 6 illustrate how the magnitude of Fi and Torque Fixture is affected before and after bottom out on the fixture respectively. This discussion of the forces further illustrates the utility of the torque restrictor as described herein. The tensile load of the screw is generally: $Fi=T/(\mu*d)$, where:

Fi=initial tensile load

T=initial torque

μ=friction coefficient on the threads d=major diameter of the screw

Here, if the user increases the installation torque, the axial torque is increased linearly. As friction is reduced, the Fi is also increased. In order to meet a desired drive screw life requirement (e.g., 500 cycles with a driving load of 50 lbs.), an appropriate lubricant can be used on the threads. This lubricant can dramatically reduce μ. Here, as friction is decreased due to the lubricant, Fi is increased. This can be detrimental in maintaining the required (or desired) User Torque of 40 in-lbs. of torque. Accordingly, a torque limiter is employed.

An installed tightened down configuration is illustrated in FIG. 6. In the static configuration, all forces and moments will balance.

For example:

$$Tt+Tf=Tu$$

$$Fi=Fi\ fixture$$

The torque fixture (Tf) is related to Fi by: $Tf=Fi*\mu f*D$

μf=friction between screw and fixture bar

D=distance of normal force Fi from centerline

A similar relationship for Torque threads (TO exists. $Tf=fi*\mu t*dmajor$

During installation, as shown in FIG. 5, before the fixture bottoms out against the front panel, the only force is due to some friction on the threads and the MCX connector kinetic frictional resistive forces, approximately 50 lbs. This translates into about approximately 5 in-lbs of torque.

The loading changes when the fixture bottoms out and gets cinched. The user is able to torque to ensure that the system is tight and the fixture to screw interface frictional forces and axial forces start to resist the user torque. The axial force also changes to do this and has to balance against the resistive torque of the fixture.

Combining all the equations and simplifying for Fi:

$$Fi=Tuser/(\mu t*d+\mu f*D)$$

From the equation, it is apparent that Fi can be dramatically changed by changing μf. As this friction coefficient is increased, more user applied torque can be allowed while keeping Fi under the yield strength of the screw material. The idea is to increase the μf between the drive screw and the cable fixture device by means of material roughening or high friction materials. Initial roughening of the interface can yield a 3× increase in allowed user applied torque from 25 in-lbs. up to 75+ in-lbs. once the interface is worn in (e.g., seasoned). Aspects of the UCH and lead screw employ chemically etched surfaces to increase the friction thereby alleviating the stresses upon the screw itself which reduces damage and increases longevity. Other aspects can employ most any technique (e.g., sanding, sand-blasting) of roughening the surface (s). Additionally, high friction washers, mechanically roughened (oscillating) surface(s) or part(s), etc. can be employed to achieve the higher friction coefficient as described herein.

In other words, the rough surfaces of the clutch plates or torque limiter produce resistive torque conventionally provided by the screw itself. Thus, this friction is uncoupled from the thread friction. Mechanical longevity is enhanced by allowing a user to excessively torque the screw while protecting the screw from the excessive forces. As the axial force increases, the force is proportional to the frictional coefficient of the opposing surface.

It will be understood that the UCH described herein can increase ease and speed of installation and removal of cables. As well, the UCH can decrease chance of mis-wire during reconnection of the LC. Still further, the UCH provides for a cleaner and more organized installation of coaxial cabling.

Figure 7:
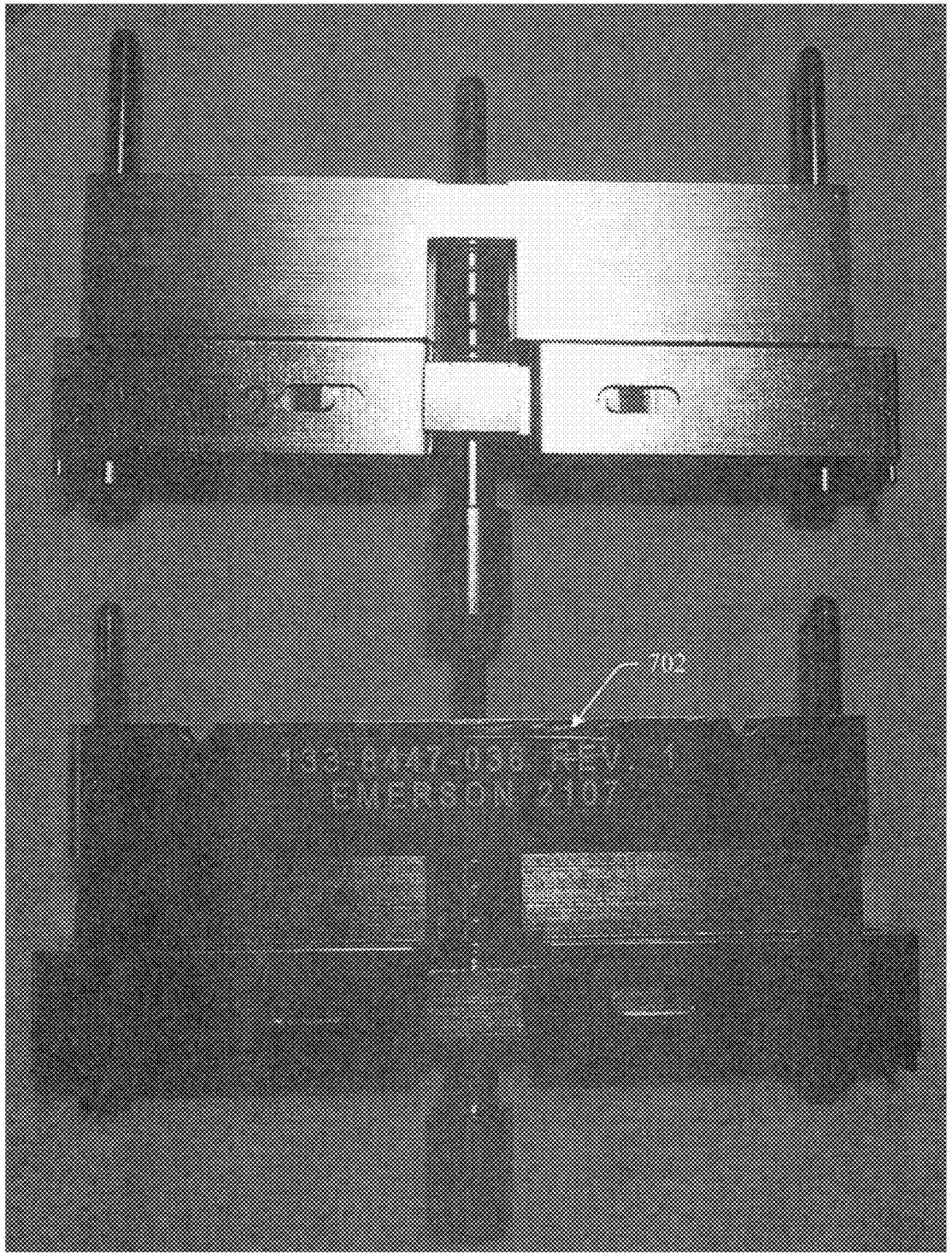
FIG. 7 illustrates a top view photograph of a UCH in accordance aspects (e.g., with shroud and without shroud).

Referring now to FIG. 7, a top view photograph of a UCH in accordance with the specification is shown. More particularly, FIG. 7 illustrates two views of a UCH. The view on the top is an image of a UCH without a protective shroud. In contrast, the lower image of FIG. 7 illustrates an optional spring loaded connector shroud 702 that can protect the connectors during installation and/or removal. While the connector shroud 702 of FIG. 7 is spring loaded, it is to be understood that the spring is optional and a shroud can be employed without a spring—thus, protecting the connectors during installation and/or removal.

Figure 8:
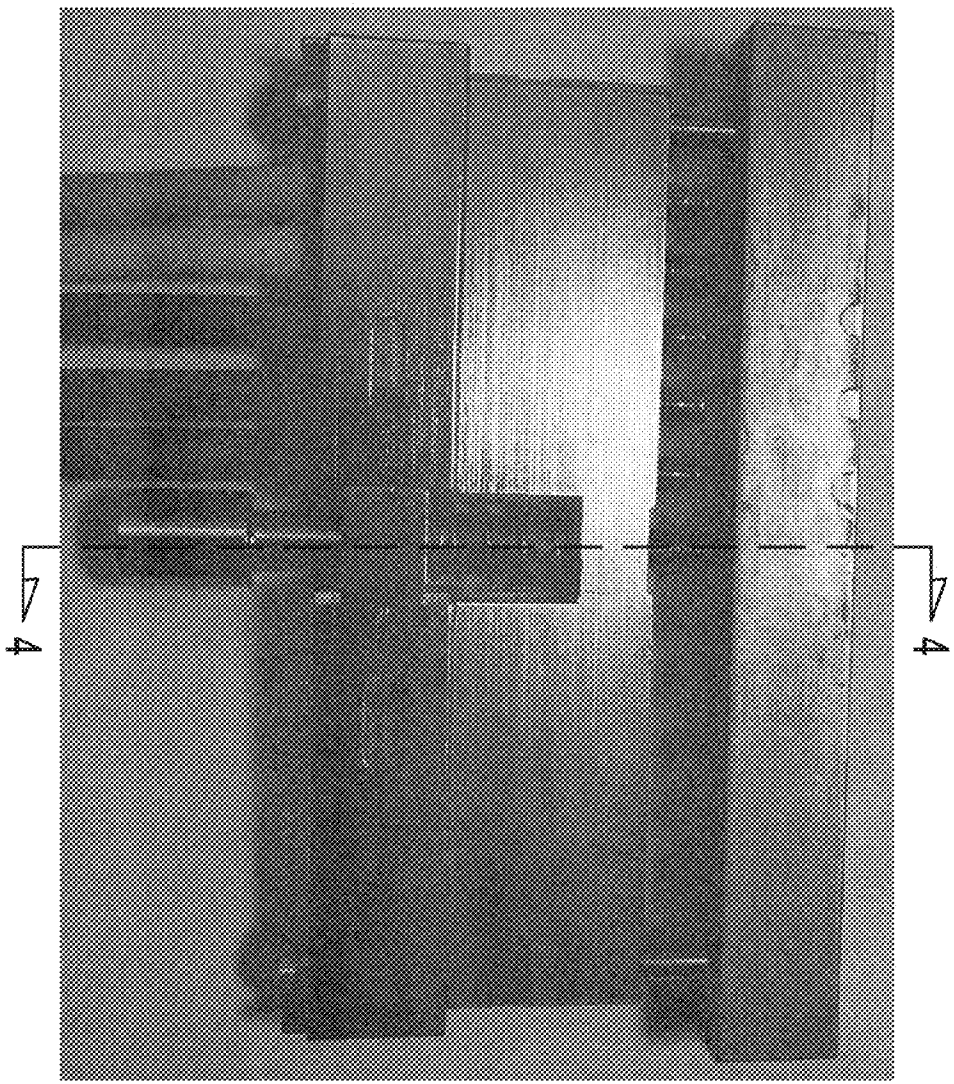
FIG. 8 illustrates a photograph of a UCH with connectors installed in accordance with an aspect.

FIG. 8 illustrates an image of a UCH with connectors installed. As shown, when connectors are installed into the UCH, they protrude past the front surface to reach into the LC for connectivity. As described above with reference to FIG. 7, a connector shroud protects the connectors when the UCH is removed from (or not yet installed into) the LC.

Figure 9:
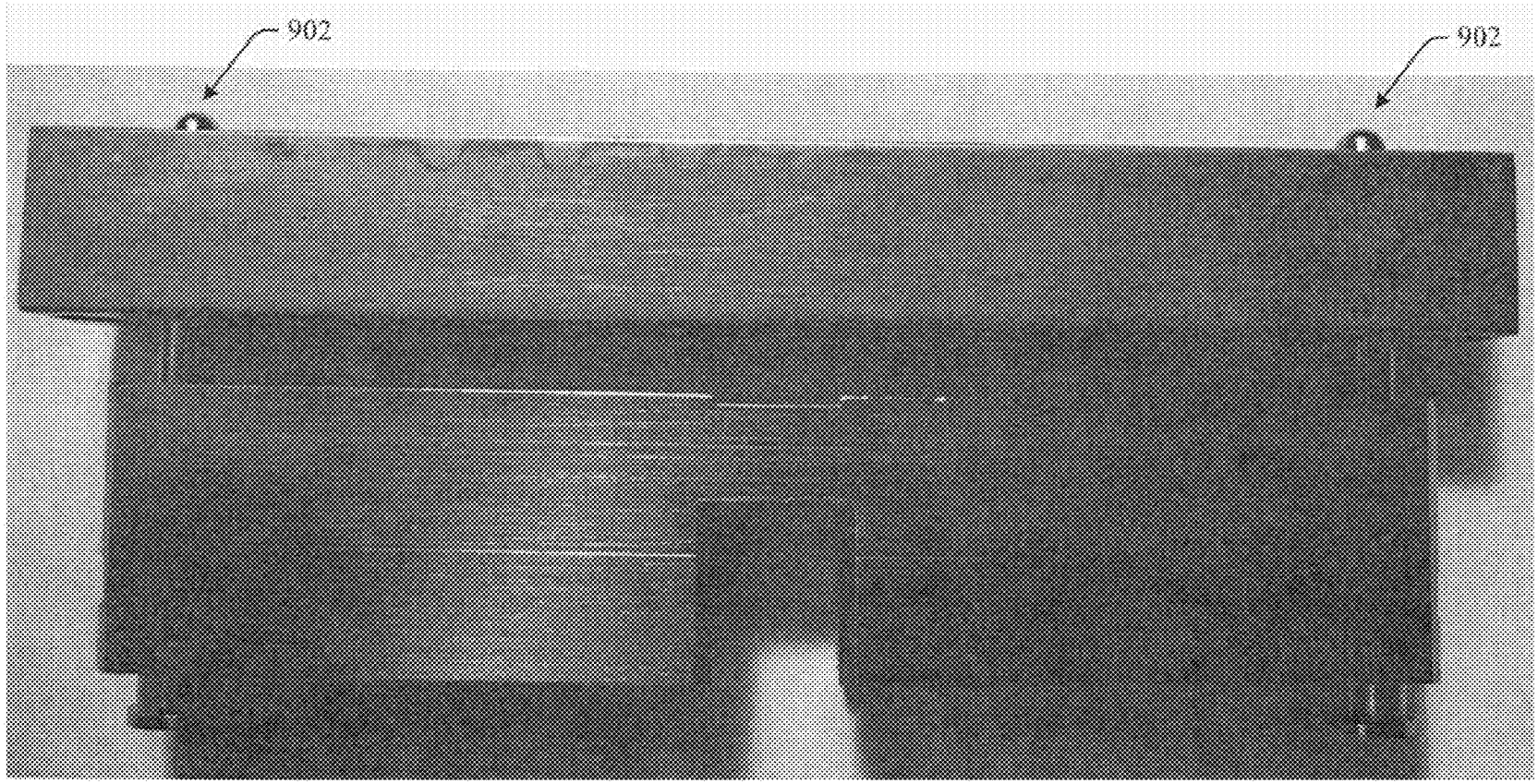
FIG. 9 illustrates a photograph that depicts protrusion of guide pins to regulate alignment in accordance with an aspect of the innovation.

It will be understood that the UCH can be designed with guide pins 902 as shown in FIG. 9. These guide pins can be provided such that they will be completely engaged prior to any connector insertion thereby limiting angular tilt (and potential connector damage).

Figure 10:
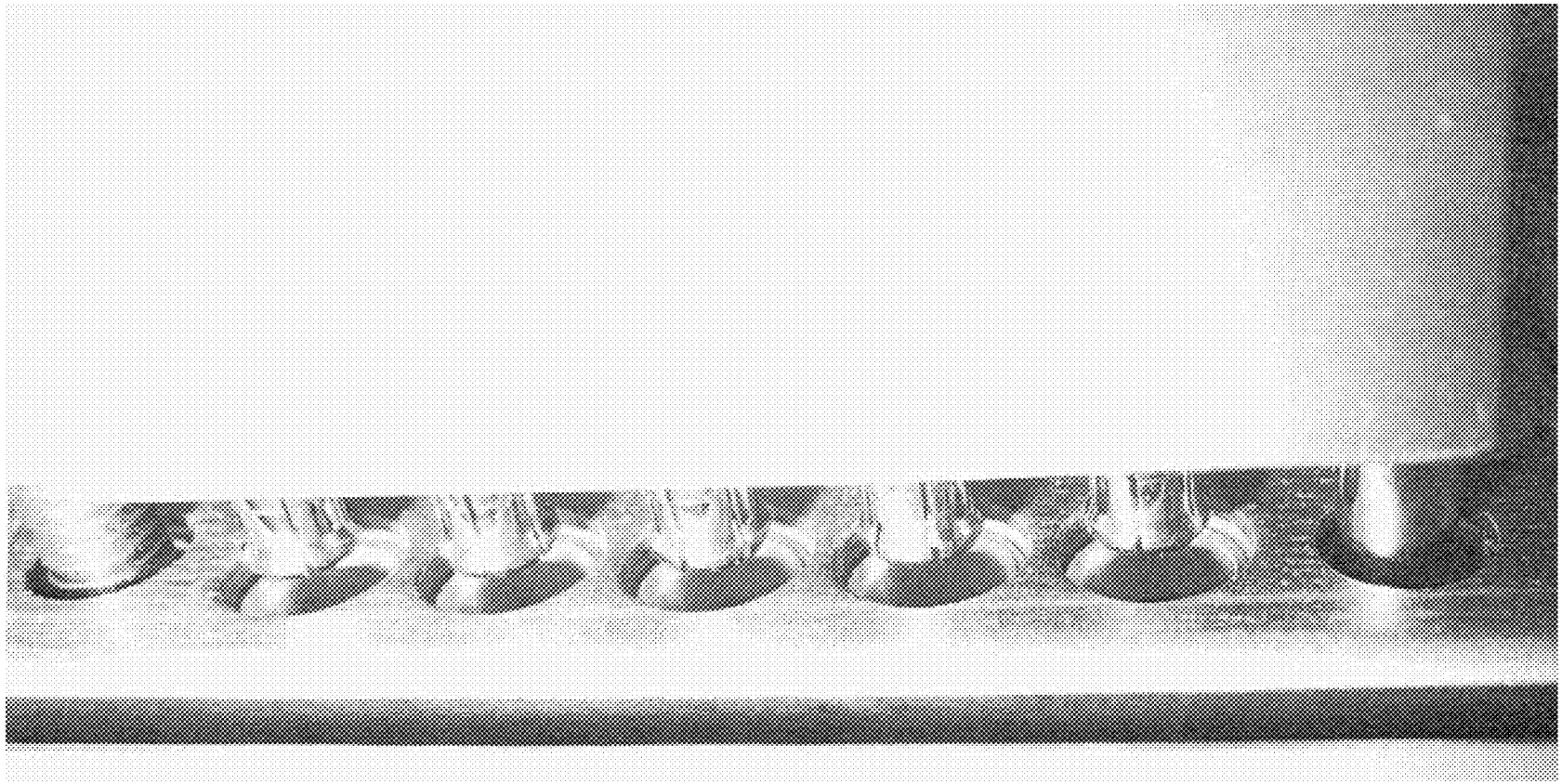
FIG. 10 illustrates a photograph that depicts a UCH engaging a faceplate upon installation in accordance with an aspect.
Figure 11:
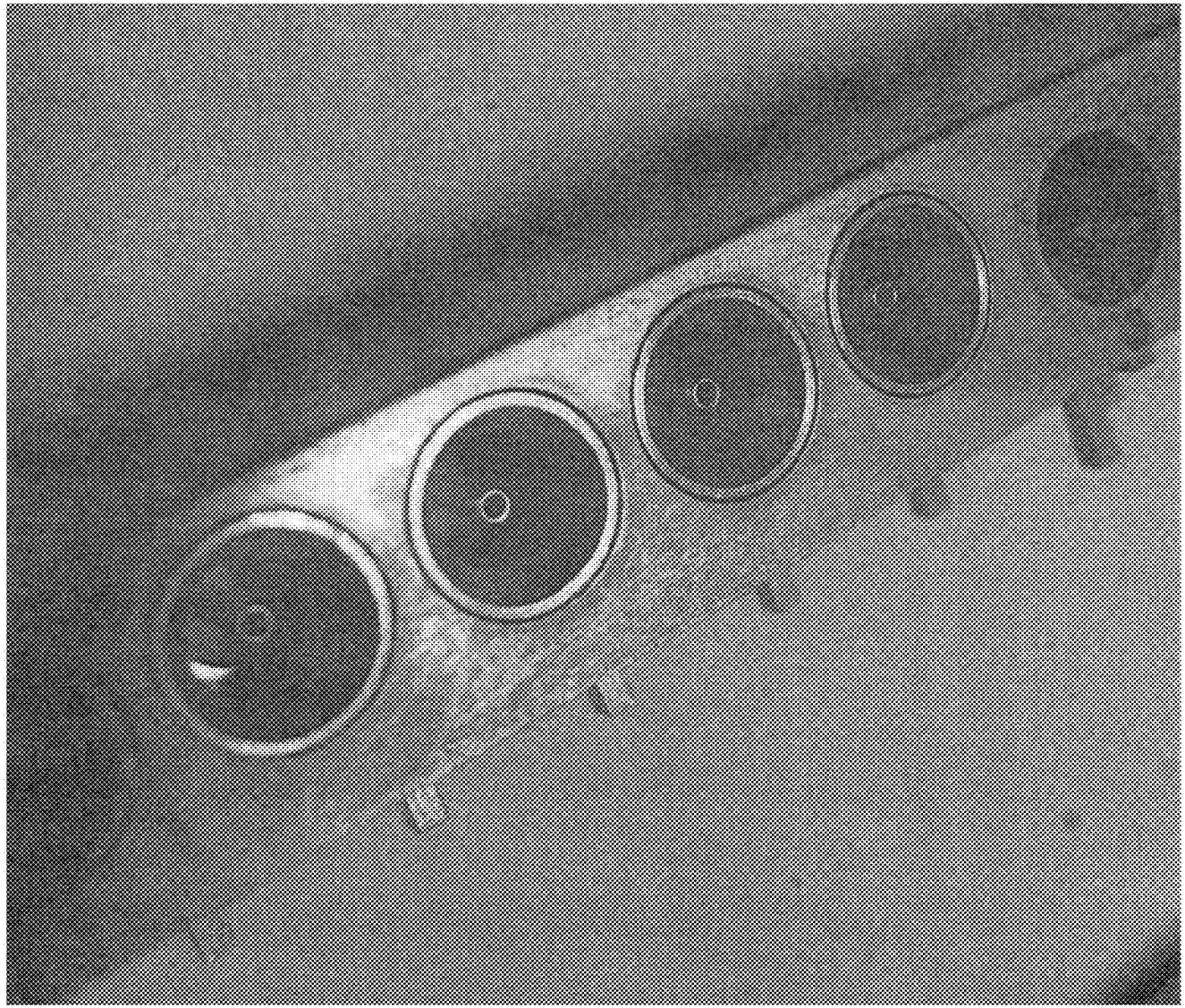
FIG. 11 illustrates the chamfered lead-ins in accordance with an aspect.

FIG. 10 is an image of a UCH engaging a faceplate upon installation. To assist gather-ability due to angular misalignment, the PCB side of the MCX receptacle can have a chamfered lead-in as shown in FIG. 11. It will be understood that these chamfered lead-ins can facilitate alignment of connectors upon installation thereby alleviating any damage to the conductor or connectors. In operation, the body of the UCH (e.g., together with alignment pins) performs course alignment to ensure that the cables align with the chamfers on the receptor. The chamfers on the receptor perform the final alignment of the cable into the connector.

Figure 12:
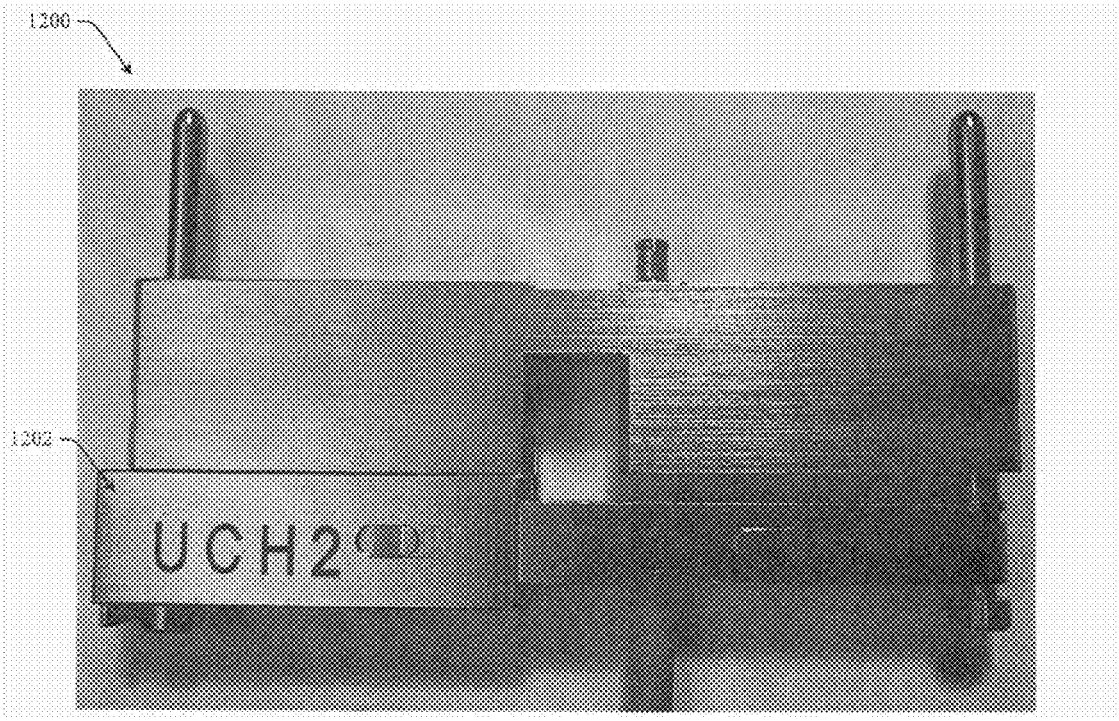
FIG. 12 illustrates a top view of a UCH in accordance with an embodiment.

FIG. 12 illustrates a top view of a UCH 1200 in accordance with the specification. In particular, the UCH 1200 includes a slider bar 1202 that facilitates locking the connectors or coaxial cables in place. As discussed herein, the slider bar 1202 holds the MCX connector in the UCH. Although many of the aspects described herein are directed to an MCX connector, it is to be understood that most any type of suitable connector and corresponding coaxial cable can be employed without departing from the spirit and/or scope of the innovation and claims appended hereto. As such, the apertures of the slider bar can include most any suitable tab or obstruction to effect retention. Similarly, port spacing can be adjusted to enable adequate obstruction material.

Figure 13:
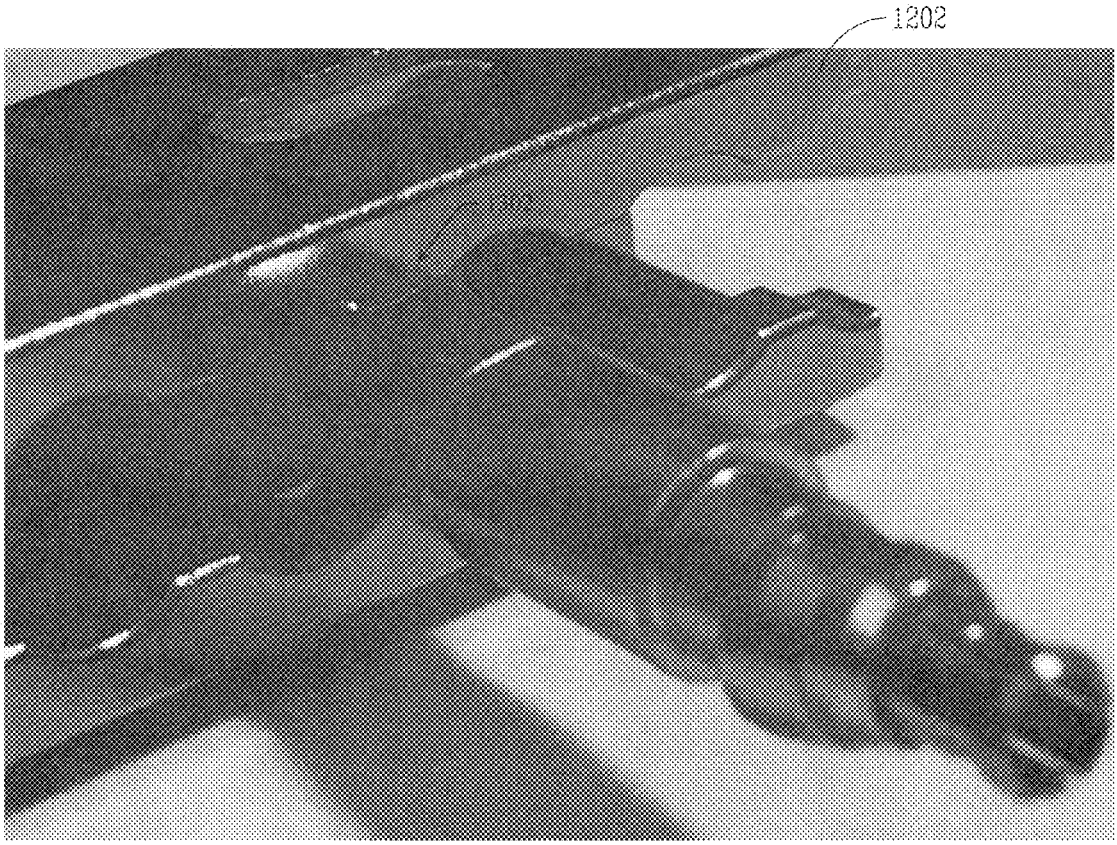
FIG. 13 illustrates the slider bar retaining a connector crimp in accordance with an aspect of the specification.

As will be illustrated in greater detail in the figures that follow, the slider bar 1202 is capable of locking against the back of the connector (e.g., MCX connector) crimp in order to retain the connector within the UCH. FIG. 13 illustrates an example slider bar that retains the connector by flat spots 1302 in the bar (1202). Here, once the cables are installed (as illustrated), the slider bar can be repositioned horizontally (e.g., slid) such that a flat spot (1302) can secure the step or ledge of an MCX crimp from being retracted. FIG. 13 is a perspective view from the LC side of the UCH connector.

Figure 14:
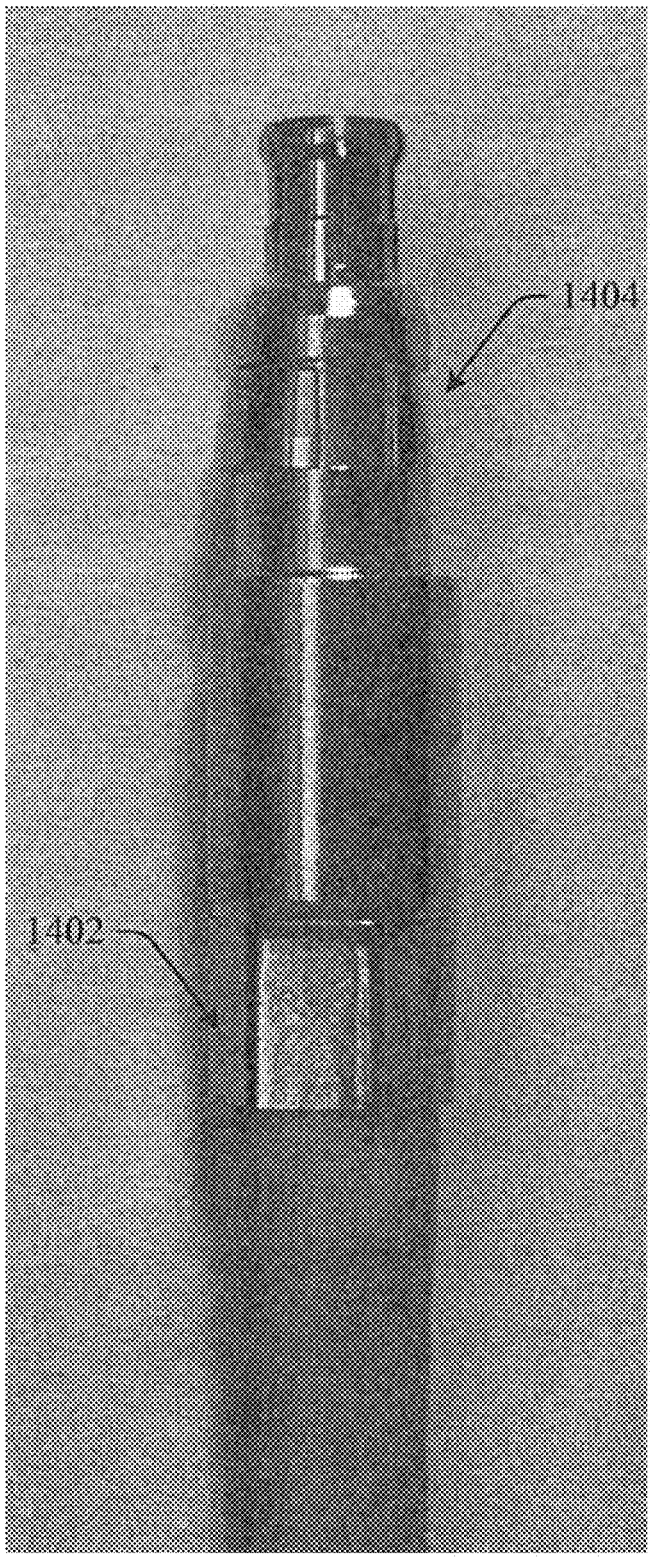
FIG. 14 illustrates an image of an example cable and MCX connector in accordance with an embodiment.

FIG. 14 illustrates an image of an example coaxial cable and MCX connector in accordance with an embodiment. As shown, crimp 1402 provides the 'stop' (e.g., step or ledge) such that the 'slider bar' can retain the cable in position thereby prohibiting retraction unless desired. It should be noted that the locking ring 1404 can be used for friction only and need not be used for holding the connector within the UCH, which is accomplished by the slider bar. Rather, when the slider bar is in the 'open' position, the locking ring can provide friction when installing or retracing a cable. This feature can prevent the cable from inadvertently falling out when troubleshooting or installing additional cables.

Figure 15A:
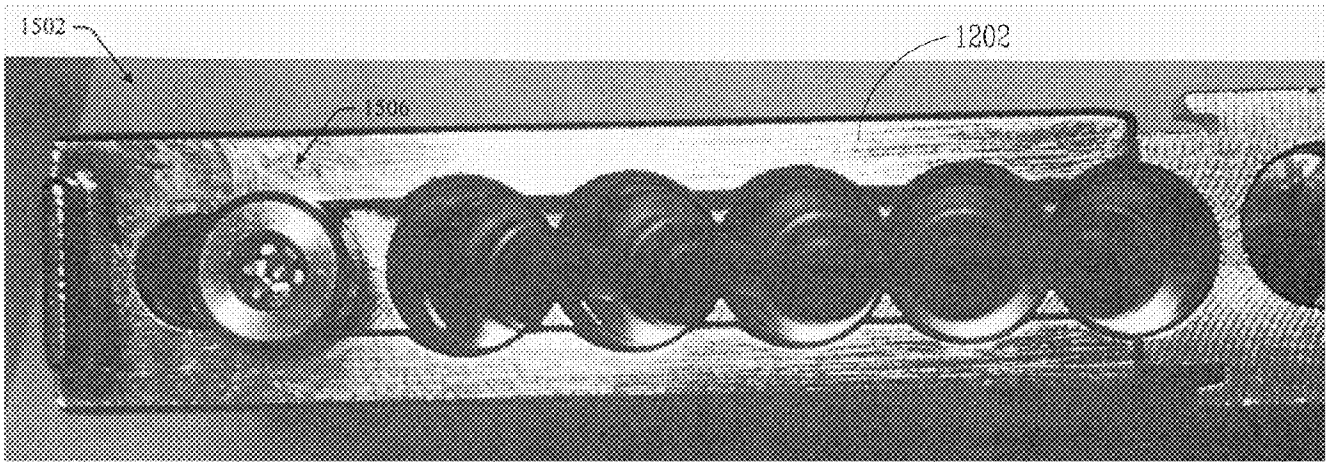
FIGS. 15A and 15B illustrate example photographs of a slider bar in an 'open' position (top) and 'closed' position (bottom) in accordance with aspects of the specification.
Figure 15B:
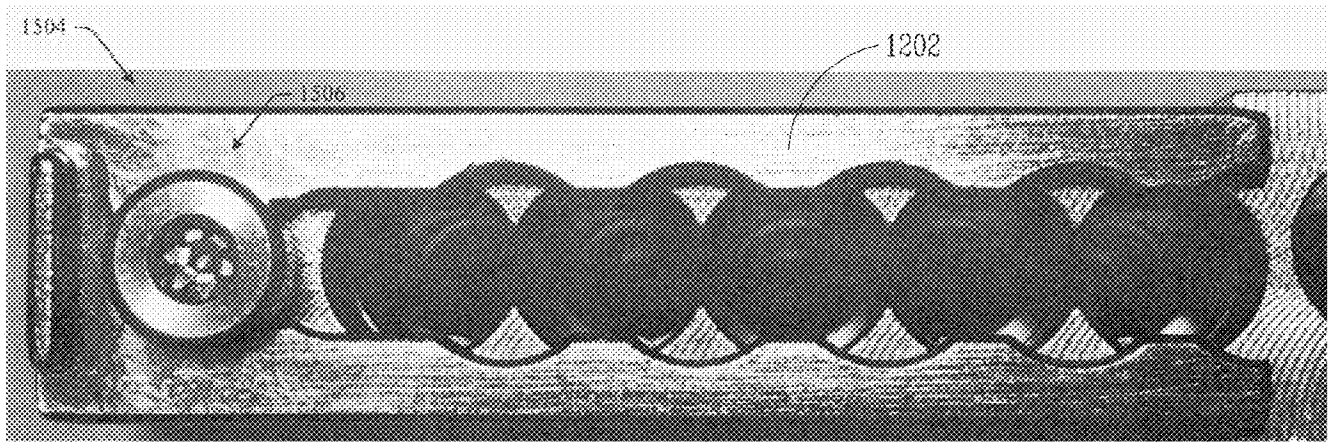
Figure 16A:
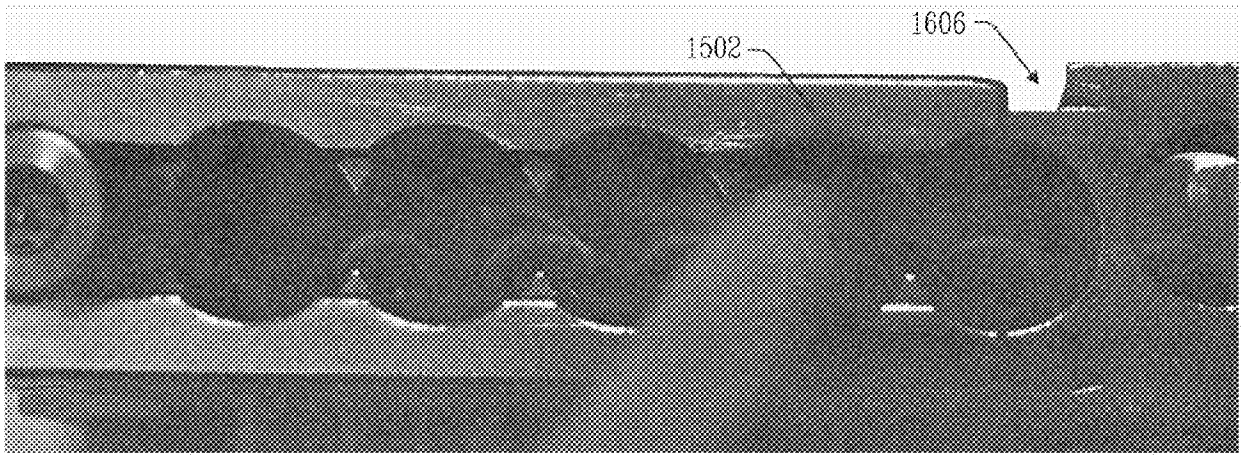
FIGS. 16A and 16B illustrate example photographs of a slider bar in an 'open' position (top) and 'closed' position (bottom) in accordance with aspects of the specification.
Figure 16B:
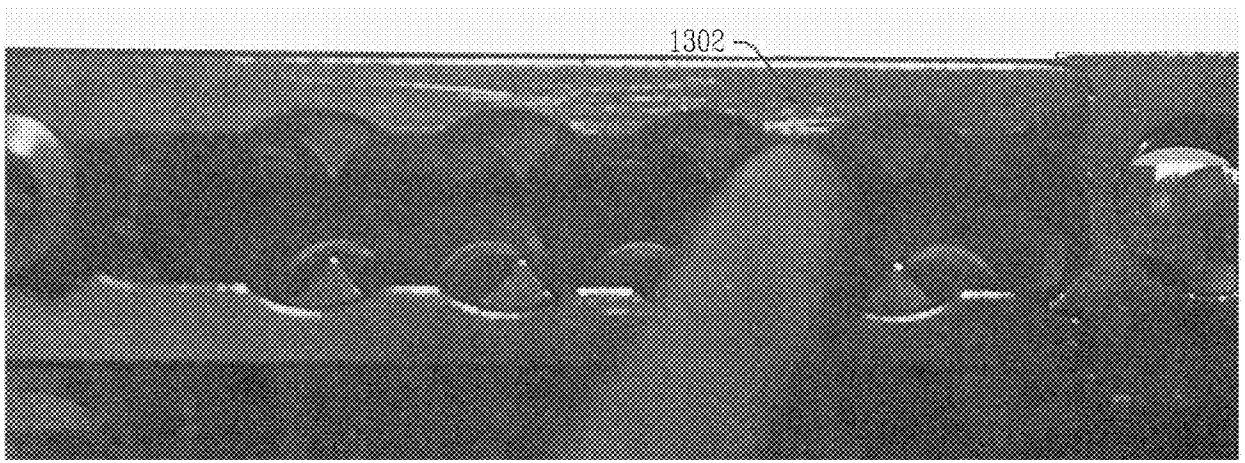

FIGS. 15A and 15B illustrate functionality of the slider bar (e.g., 1202 of FIG. 12). More particularly, when the slider bar is in the open position (1502), cables can be easily installed without obstruction. Once installed, the slider bar can be repositioned (1504) horizontally such that flat spots of the bar reshape entry apertures into the UCH. As described above, here the cable can be retained in the UCH as the MCX crimp will not fit through the reshaped aperture. This feature is illustrated in FIGS. 16A and 16B that follow. A screw (1506) or other appropriate retention device (e.g., clip, indent . . . ) can be employed to secure the slider bar in an open or closed position as desired.

Referring to FIG. 16A, in the 'open' or 'unlocked' position (1502) the cable can be easily passed through the slider bar for connection to the LC. Here, in the open position, the holes line up on the slider bar with the holes in the crossbar allowing for connector installation. However, when the slider bar is repositioned (FIG. 16B), a flat spot (1302) in the bar can be positioned over the cable thereby holding the cable into position. In other words, the crimp of the cable connector will not fit through the reshaped opening thereby holding the cable within the DCH. Accordingly, in the 'closed' or 'locked' position, the flats are shifted such that the connector cannot be removed because it is positioned behind the slider bar. It is to be appreciated that the connectors can be locked into place by moving the slider bar into the body until it overlaps with the lip (1606) of the crossbar (optional). This overlap can be seen in FIG. 16B when the slider bar is in the 'closed' or 'locked' position (lower image).

As described above and shown in FIG. 17, one feature of the UCH is that it provides for easy and efficient cable removal. For instance, the UCH design enables a user to remove a single cable (or other number of cables) easily for service, troubleshooting, reconfiguration, etc. To remove a single cable, an operator can slide the slider bar into the 'open' position and pull out the desired cable(s). Since the PCB side MCX receptacle retains the MCX connector retention feature, the other cables will remain held in the MCX connector with some nominal force provided by the connector.

Figure 17:
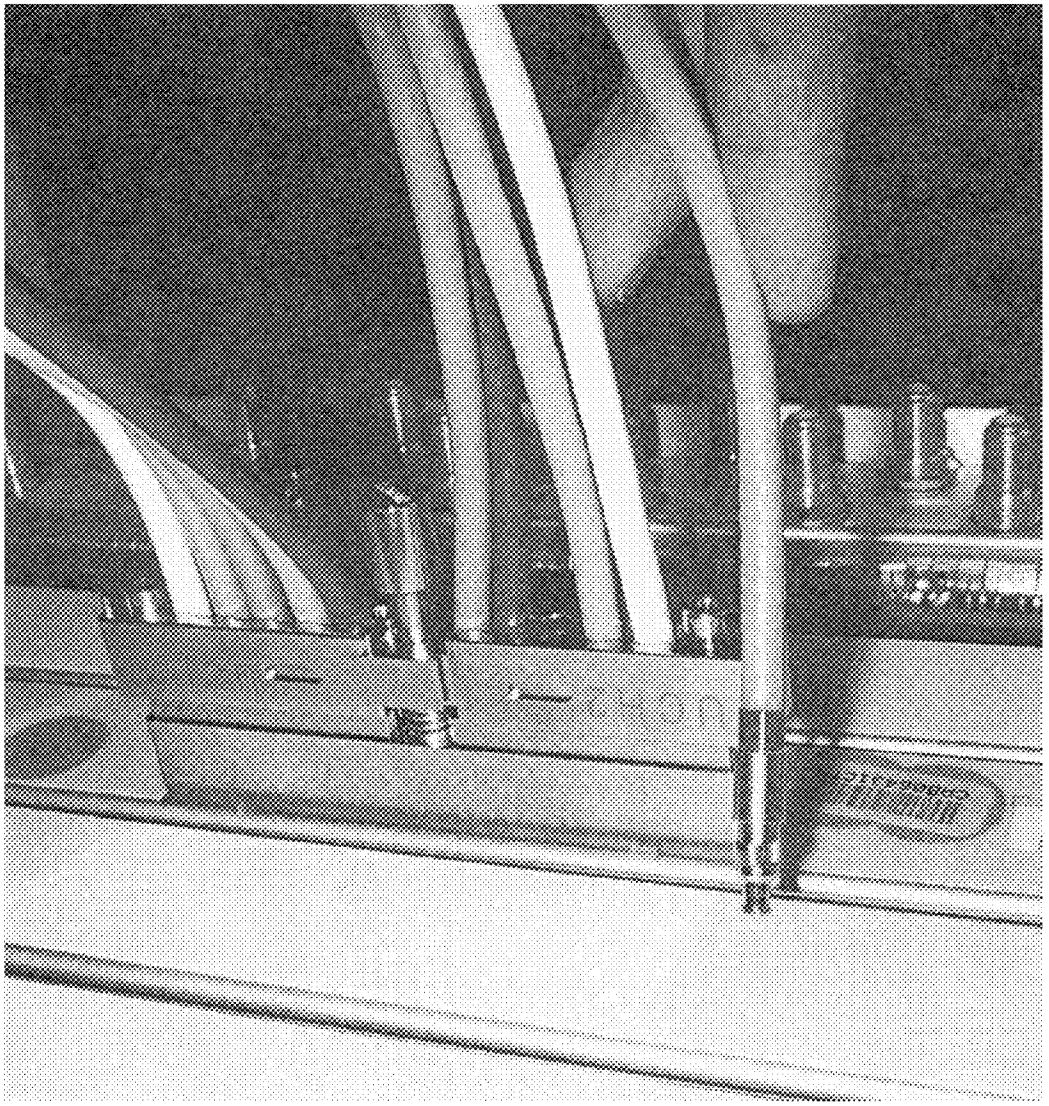
FIG. 17 illustrates a UCH with a single cable removed in accordance with an aspect.

In the aspect shown in FIG. 17, only half the connector is open at one time limiting the exposure of disconnecting unwanted cables. In other words, as described supra, a single UCH can be equipped with multiple (e.g., 2) slider bars which correspond to a respective number of cables. It will be understood that care should be taken so as to not inadvertently remove unwanted cables as, when the slider bar is in the open position, the cables are held in place with only approximately 3 to 5 lbs. of force. Other aspects can hold the cables with other limited forces, however, this specific example is noted in connection with an example MCX connector.

Figure 18:
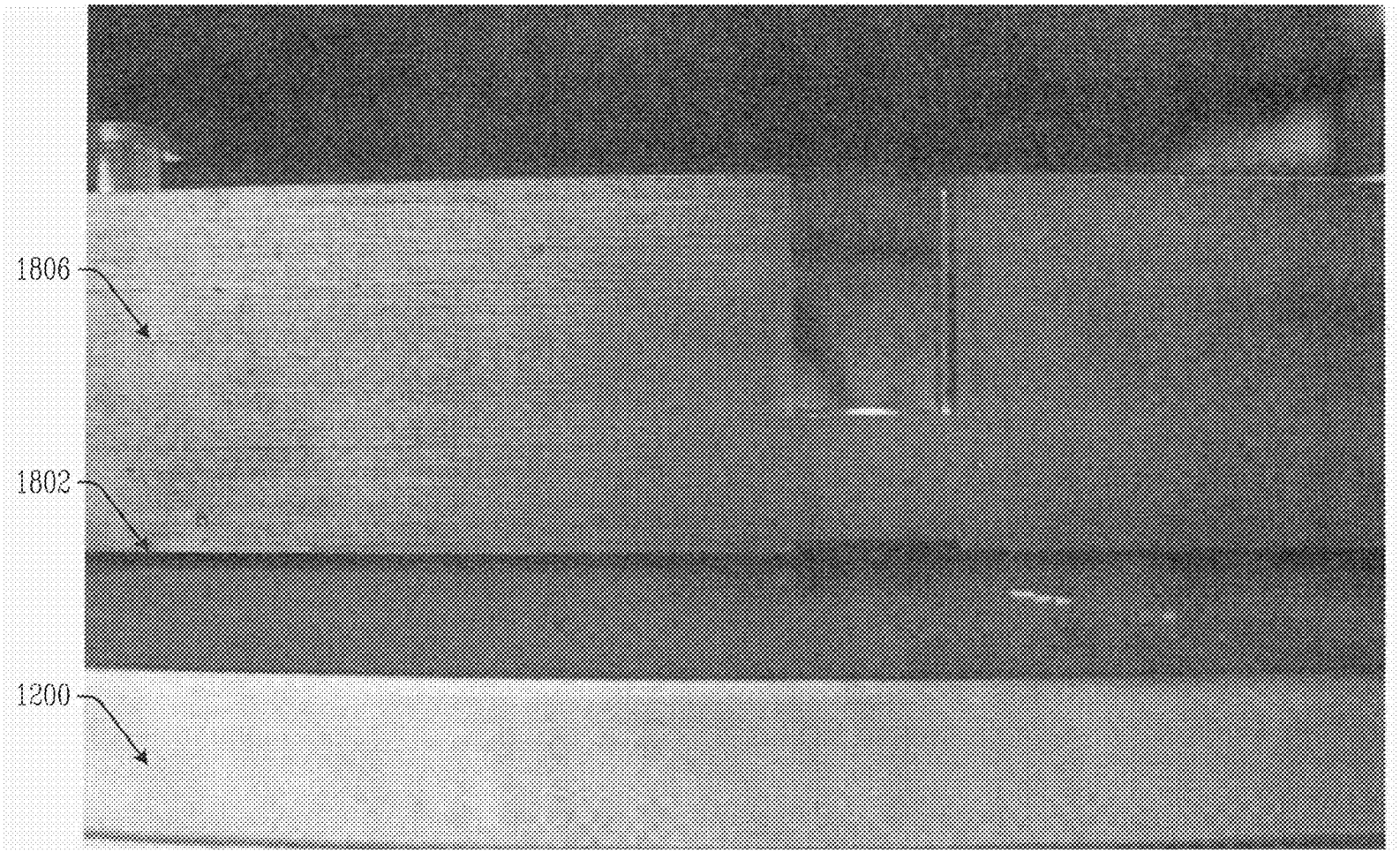
FIG. 18 illustrates a gasket between the UCH and a LC (linecard) in accordance with an aspect of the innovation.

FIG. 18 is an example photograph of an example EMI (electromagnetic interference) gasket 1802 that can be molded into the housing of the UCH 1200 or placed between the UCH and the faceplate 1806 in order to aid in sealing emissions coming from the MCX (or other cable) connector itself. In one embodiment, the gasket can be an elastomer EMI gasket and injected molded into the UCH to effect a desired seal. Thus, when the UCH comes into contact with the front panel, the gasket 1802 can compress thereby providing better grounding and seal around the connectors for emissions purposes. In other words, the gasket 1802 can assist in containing emissions that come off the cable interfaces (e.g., MCX connectors).

What has been described above includes examples of the specification. It is, of course, not possible to describe every conceivable combination of components or methodologies for purposes of describing the subject specification, but one of ordinary skill in the art may recognize that many further combinations and permutations of the specification are possible. Accordingly, the specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparatus, comprising:

a housing to accept a plurality of cables, an end of each of the plurality of cables protruding from the housing, the plurality of cables being hardware component interconnection cables;

a lead screw mounted on the housing to attach the housing to a receptor, to connect the protruding ends of the plurality of cables accepted in the housing to the receptor;

a torque limiter to produce resistive torque and alleviate stress from the lead screw as the lead screw draws the housing to the receptor, the torque limiter located at an interface between the lead screw and the housing; and a mechanism mounted on the housing to move transverse to the ends of the plurality of cables, wherein when in a closed position, the mechanism secures the end of each of the cables in connection with the receptor and obstructs pulling of the end of each of the cables from the housing, and wherein when the mechanism is in an open position, enables individual removal by pulling of each of the cables from the receptor.

2. The apparatus of claim 1, wherein the plurality of cables are coaxial cables.

3. The apparatus of claim 1, further comprising a retainer to secure the mechanism to the housing in one of the open or closed position.

4. The apparatus of claim 3, wherein the retainer is one of a screw, clip or indent.

5. The apparatus of claim 1, wherein the lead screw is to attach the housing to a faceplate of the receptor, wherein each of the cables connects to the faceplate.

6. The apparatus of claim 1, wherein the torque limiter comprises at least one of chemically etched material, sanded material, sand-blasted material, or a friction washer that produces the resistive torque.

7. The apparatus of claim 1, further comprising a shroud that protects a connector on the protruding end of each of the cables during at least one of installation or removal of each of the cables.

8. The apparatus of claim 7, wherein the shroud is spring-loaded.

9. The apparatus of claim 1, further comprising at least two guide pins on the housing to engage with the receptor, to regulate alignment of the housing to the receptor.

10. The apparatus of claim 1, wherein the receptor includes chamfered lead-ins that regulate alignment of a connector on the protruding end of each of the cables.

11. The apparatus of claim 1, further comprising an EMI (electromagnetic interference) gasket that contains emissions from each of the cable connections, wherein the EMI gasket is positioned between the housing and a faceplate of the receptor.

12. The apparatus of claim 11, wherein the EMI gasket is molded into the housing.

13. A universal cable holder (UCH), comprising:

a housing to enclose a plurality of cables, an end of each of the plurality of cables protruding from the housing;

means for selectively securing a subset of the plurality of cables to the housing by obstructing pulling the end of each cable of the subset from the housing;

means for securing the housing to a faceplate of a receptor, the protruding ends of the plurality of cables being connected to the receptor, the means for securing the housing to the faceplate including a retention screw; and a torque limiter to produce resistive torque responsive to torque applied to the retention screw, the torque limiter located at an interface between the retention screw and the housing.

14. The UCH of claim 13, wherein the torque limiter includes a chemically etched clutch on the retention screw that produces a resistive torque that is proportional to the amount of torque applied to the retention screw.

15. The UCH of claim 13, wherein the means for selectively securing the subset of the plurality of cables is a slider bar that includes a plurality of apertures, wherein, when in a closed position, is misaligned with respective holes for the cables of the subset in the housing, to secure the subset of the plurality of cables.

16. A method of connecting coaxial cables to a receptor, comprising:

inserting a plurality of coaxial cables into a housing, an end of each of the plurality of cables protruding from the housing to connect to the receptor;

sliding a locking mechanism mounted on the housing into a closed position to secure the plurality of coaxial cables in the housing by obstructing pulling of the end of the plurality of cables from the housing;

aligning at least two alignment mechanisms on the housing into a faceplate of the receptor; and tightening a securing mechanism that draws the housing to the faceplate and connects the protruding ends of the plurality of cables to the receptor, wherein the securing mechanism includes a torque restrictor, the torque restrictor located at an interface between the securing mechanism and the housing.

17. The method of claim 16, comprising:

sliding the locking mechanism into an open position; and removing a subset of the plurality of the coaxial cables from connection with the receptor and from the housing, while maintaining live connection of the other of the plurality of coaxial cables.

* * * * *